US010086418B2

(12) United States Patent
Song et al.

(10) Patent No.: US 10,086,418 B2
(45) Date of Patent: Oct. 2, 2018

(54) SHAPE-CORRECTING AND ROLLING METHOD AND SHAPE-CORRECTING DEVICE FOR HIGH-STRENGTH STEEL

(71) Applicant: POSCO, Pohang-Si, Gyeongsangbuk-Do (KR)

(72) Inventors: Gil-Ho Song, Gwangyang-si (KR); Jae-Woong Byun, Gwangyang-si (KR); Nam-Il Jo, Gwangyang-si (KR); Sang-Kug Je, Gwangyang-si (KR); Jae-Wook Bae, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 183 days.

(21) Appl. No.: 14/647,439

(22) PCT Filed: Dec. 27, 2012

(86) PCT No.: PCT/KR2012/011542
§ 371 (c)(1),
(2) Date: May 26, 2015

(87) PCT Pub. No.: WO2014/098297
PCT Pub. Date: Jun. 26, 2014

(65) Prior Publication Data

US 2015/0306645 A1 Oct. 29, 2015

(30) Foreign Application Priority Data

Dec. 21, 2012 (KR) ..... 10-2012-0150135

(51) Int. Cl.
*B21B 1/26* (2006.01)
*B21B 15/00* (2006.01)
(Continued)

(52) U.S. Cl.
CPC ..... *B21B 1/26* (2013.01); *B21B 1/22* (2013.01); *B21B 15/005* (2013.01); *B21B 27/06* (2013.01);
(Continued)

(58) Field of Classification Search
CPC ..... B21B 1/26; B21B 15/005; B21B 27/08; B21B 37/32; B21B 2001/225; B21B 2001/228; B21B 2027/086
See application file for complete search history.

(56) References Cited

U.S. PATENT DOCUMENTS 4,793,172 A 12/1988 Eibe
5,119,886 A 6/1992 Fletcher et al.
(Continued)

FOREIGN PATENT DOCUMENTS

CA 1004066 A 1/1977
CN 101670372 A 3/2010
(Continued)

OTHER PUBLICATIONS

Extended European Search Report issued in corresponding European Patent Application No. 12890177.4, dated Apr. 5, 2016.
(Continued)

*Primary Examiner* — Debra Sullivan
(74) *Attorney, Agent, or Firm* — McDermott Will & Emery LLP

(57) ABSTRACT

There are provided a shape-correcting and rolling method and a shape-correcting device for effectively correcting the shape of high-strength steel. The shape-correcting and rolling method includes: transferring a hot-rolled coil to a pay-off reel after cooling the hot-rolled coil or directly through a hot rolling to skin pass mill direct transfer process; unwinding the coil from the pay-off reel; correcting a shape
(Continued)

of a strip unwound from the coil by using a heat pipe roller; and rewinding the strip as a coil.

15 Claims, 8 Drawing Sheets

(51) Int. Cl.

| | |
|---|---|
| ***B21B 27/06*** | (2006.01) |
| ***B21B 1/22*** | (2006.01) |
| *C21D 8/02* | (2006.01) |
| *B21D 1/02* | (2006.01) |
| *B21C 47/02* | (2006.01) |
| *B21C 47/16* | (2006.01) |
| *B21B 27/08* | (2006.01) |

(52) U.S. Cl.
CPC ..... *C21D 8/0242* (2013.01); *B21B 2001/228* (2013.01); *B21B 2027/086* (2013.01); *B21C 47/02* (2013.01); *B21C 47/16* (2013.01); *B21D 1/02* (2013.01); *C21D 8/0226* (2013.01)

(56) References Cited

U.S. PATENT DOCUMENTS

| | | | | |
|---|---|---|---|---|
| 5,823,037 | A | 10/1998 | Kim et al. | |
| 5,832,985 | A * | 11/1998 | Pleschiutschnigg | B21B 1/463 164/417 |
| 5,984,848 | A | 11/1999 | Hyllberg et al. | |
| 6,240,617 | B1 * | 6/2001 | Nitoh | B21B 1/26 29/33 C |
| 6,327,883 | B1 | 12/2001 | Noe et al. | |
| 6,776,857 | B2 | 8/2004 | Lee | |
| 2004/0239013 | A1 * | 12/2004 | Bodin | B21B 1/26 266/111 |
| 2010/0175452 | A1 | 7/2010 | Ohlert et al. | |
| 2011/0097973 | A1 | 4/2011 | Jin et al. | |
| 2013/0337282 | A1 | 12/2013 | Oishi et al. | |

FOREIGN PATENT DOCUMENTS

| | | | |
|---|---|---|---|
| CN | 101755058 | A | 6/2010 |
| EP | 1 452 247 | A1 | 9/2004 |
| JP | 57-009501 | A | 1/1982 |
| JP | 61-269901 | A | 11/1986 |
| JP | 04-188585 | A | 7/1992 |
| JP | 07-204704 | A | 8/1995 |
| JP | 10-005809 | A | 1/1998 |
| JP | 10-192915 | A | 7/1998 |
| JP | 2000-054098 | A | 2/2000 |
| JP | 2001-105006 | A | 4/2001 |
| JP | 2007-044751 | A | 2/2007 |
| JP | 2008-213015 | A | 9/2008 |
| JP | 2010-530807 | A | 9/2010 |
| JP | 2010-240691 | A | 10/2010 |
| JP | 2011-167736 | A | 9/2011 |
| JP | 2011-526543 | A | 10/2011 |
| JP | 2012-172254 | A | 9/2012 |
| KR | 2000-0010065 | U | 6/2000 |
| KR | 10-2004-0049855 | A | 6/2004 |
| KR | 10-2010-0007940 | A | 1/2010 |

OTHER PUBLICATIONS

Notice of Office Action issued in corresponding Japanese Patent Application No. 2015-549232, dated May 24, 2016; with English translation.

International Search Report issued in corresponding International Patent Application No. PCT/KR2012/011542, dated Jun. 21, 2013; 4 pages with English translation.

Office Action issued in corresponding Chinese Patent Application No. 201280077682.5, dated Jan. 4, 2016.

* cited by examiner

SHAPE-CORRECTING AND ROLLING METHOD AND SHAPE-CORRECTING DEVICE FOR HIGH-STRENGTH STEEL

RELATED APPLICATIONS

This application is the U.S. National Phase under 35 U.S.C. § 371 of International Patent Application No. PCT/KR2012/011542, filed on Dec. 27, 2012, which in turn claims the benefit of Korean Patent Application No. 10-2012-0150135, filed on Dec. 21, 2012, the disclosures of which Applications are incorporated by reference herein.

TECHNICAL FIELD

The present disclosure relates to a shape-correcting and rolling method and a shape-correcting device for high-strength steel, and more particularly, to a shape-correcting and rolling method and a shape-correcting device using heat pipe rollers for correcting the shape of high-strength steel within a warm working temperature range.

BACKGROUND ART

The strength of steel sheets used in the automobile industry has been constantly increased to allow automobiles satisfying environmental regulations and having high fuel efficiency to be manufactured. However, it is difficult to form high-strength steel strips into desired shapes, and the load required in processes for correcting the shapes of high-strength steel strips is high. In addition, even in the case that high-strength steel is processed using a shape-correcting process, the shape of the high-strength steel may not be easily corrected. Due to this reason, after increasing the temperature of a steel strip, the shape of the steel strip may be corrected. In this case, if the strip is corrected within a warm working temperature range without using a roll cooling device, work rolls may be heated by the strip and expanded to have a large crown shape known as a thermal crown, and thus, uncontrollable severe wave shapes may be formed in the center region of the strip, rendering the strip useless as a product.

Moreover, in a correcting process, a large amount of scale formed on a steel strip may be separated therefrom, and when cooling water is applied to cool rolls, the separated scale may scatter to cause secondary surface defects, thereby making it difficult to use cooling water.

In the related art, cooling is not performed due to this reason, and thus, a shape-correcting process is restrictively performed at a strip temperature of about 50° C. In this case, however, the effect of the shape-correcting process is low, and the number of steel strips that can be continuously rolled is limited. In addition, it is necessary to supply a warm-rolling workpiece immediately before rolls are changed and to change the rolls after warm rolling.

Patent Document 1 (please refer to FIG. 1) discloses a technique for economically manufacturing high-strength strips by unwinding a hot-rolled strip 3, having a temperature higher than a surrounding temperature, from a pay-off reel 4, correcting the strip 3 using a correcting machine 5, and passing the strip 3 through a furnace 6 to anneal the strip 3. Patent Document 2 discloses a technique for performing a skin pass milling process on high-tension steel within a warm-working temperature range of 60° C. to 120° C.

However, Patent Documents 1 and 2 only state the effects of a shape-correcting process or a skin pass milling process performed within a warm-working temperature range higher than room temperature but do not state how the shape-correcting process is practically performed within the warm-working temperature range. That is, Patent Documents 1 and 2 do not disclose the possibility of shape errors caused by deformation of rolls heated when a strip is merely corrected at a temperature higher than room temperature.

(Patent Document 1) KR10-1153732 B (Patent Document 2) JPH10-005809 A

DISCLOSURE

Technical Problem

An aspect of the present disclosure may provide a shape-correcting and rolling method for effectively correcting the shape of high-strength steel.

An aspect of the present disclosure may also provide a shape-correcting device for high-strength steel. The shape-correcting device may optimally correct the shape of a strip of high-strength steel regardless of the temperature of the strip, the number of rolled coils, and the feeding order of workpieces.

An aspect of the present disclosure may also provide a shape-correcting and rolling method for high-strength steel and a shape-correcting device for high-strength steel, designed to reduce or remove a waiting period in a yard, which can last for three to five days in the related art and thus to directly connect a hot rolling and coiling process to a shape-correcting and rolling process.

Technical Solution

To achieve the above-mentioned aspects of the present disclosure, a shape-correcting and rolling method and a shape-correcting device are provided.

According to an aspect of the present disclosure, a shape-correcting and rolling method for high-strength steel may include: performing a hot rolling to skin pass mill direct transfer process by transferring a hot-rolled coil to a pay-off reel; unwinding a strip from the coil of the pay-off reel; correcting a shape of the strip by using a heat pipe roller; and rewinding the strip as a coil.

According to another aspect of the present disclosure, a shape-correcting and rolling method for high-strength steel may include: performing a first transfer process by transferring a hot-rolled coil to a temperature adjusting unit; cooling the coil while monitoring a temperature of the coil; performing a second transfer process by transferring the coil cooled to a temperature of 150° C. or higher to a pay-off reel; unwinding a strip from the coil of the pay-off reel; correcting a shape of the strip by using a heat pipe roller; and rewinding the strip as a coil.

Prior to the correcting of the shape of the strip, the method may further include rolling the strip at a reduction ratio of 20% to 30%, and prior to the rolling of the strip, the method may further include removing scale from surfaces of the strip by shot blasting.

In the correcting of the shape of the strip, the strip may have a temperature equal to or higher than 150° C. but lower than a phase transformation temperature.

The method may further include warm-rolling the strip continuously after the rewinding of the strip.

The cooling of the coil may include: measuring the temperature of the coil; and comparing the measured temperature of the coil with a predetermined temperature range so as to determine whether the measured temperature of the coil is within the predetermined temperature range.

The cooling of the coil may be performed by placing the coil on a skid in a yard, and a thermocouple disposed in the skid may indirectly measure the temperature of the coil by measuring a temperature of the skid heated by the coil placed on the skid.

A heat insulating process may be performed on the coil during the unwinding of the coil, so as to prevent cooling of the coil.

Prior to the correcting of the shape of the strip, the method may further include heating the strip so that the strip may have a uniform temperature.

The correcting of the shape of the strip may be performed using a skin pass mill which includes a pair of heat pipe rollers making contact with the strip and backup rolls supporting the heat pipe rollers.

Each of the heat pipe rollers may include a plurality of first heat pipes extending in a length direction of the heat pipe roller from an end to a center region of the heat pipe roller and a plurality of second heat pipes extending from an opposite end to a center region, and the first and second heat pipes may be alternately arranged in a circumferential direction of the heat pipe roller.

The first and second heat pipes may overlap each other in the center region in the length direction of the heat pipe roller.

According to another aspect of the present disclosure, a shape-correcting device for high-strength steel may include: a pay-off reel from which a coil is unwound; a skin pass mill correcting a strip unwound from the coil of the pay-off reel; and a coiler rewinding the strip after the strip passes through the skin pass mill, wherein the skin pass mill may include a work roll that is a heat pipe roller in which heat pipes are installed.

The heat pipes may include a plurality of first heat pipes extending in a length direction of the work roll from an end to a center region of the work roll and a plurality of second heat pipes extending from an opposite end to a center region, and the first and second heat pipes may be alternately arranged in a circumferential direction of the work roll.

The heat pipes may be uniformly arranged in the circumferential direction of the work roll at a predetermined insertion depth.

A heating device may be disposed between the pay-off reel and the skin pass mill so as to heat the strip to a temperature equal to or higher than 150° C. but lower than a phase transformation temperature.

The first and second heat pipes may overlap each other in the center region in the length direction of the work roll.

The method may further include a shot blaster configured to shoot steel balls having a micrometer (μm) size toward the strip and a rolling mill disposed behind the shot blaster to roll the strip, wherein the shot blaster and the rolling mill may be disposed between the pay-off reel and the skin pass mill.

Advantageous Effects

As described above, the present disclosure provides a shape-correcting device and a shape-correcting device for effectively correcting the shape of high-strength steel.

According to the shape-correcting and rolling method and the shape-correcting device of the present disclosure, the shape of a strip of high-strength steel may be optimally corrected regardless of the temperature of the strip, the number of rolled coils, and the feeding order of workpieces.

In addition, according to the shape-correcting and rolling method and the shape-correcting device of the present disclosure, a waiting period in a yard which normally lasts three to five days in the related art may be reduced or removed to directly connect a hot rolling and coiling process to a shape-correcting and rolling process. Therefore, yards may be efficiently used, and inventory may be reduced or storage thereof may be unnecessary.

<Descriptions of reference numerals>

| | |
|---|---|
| 30: PAY-OFF REEL | 31: SHOT BLASTER |
| 32: HEATING DEVICE | 33: ROLLING MILL |
| 35: COILER | 40: SKIN PASS MILL |
| 100: HEAT PIPE ROLLER | 102: ROLLING PORTION |
| 103: NECK PORTION | 104: JOURNAL |
| 105: FIRST HEAT PIPE | 106: SECOND HEAT PIPE |
| 110: HEAT PIPE | 111: PIPE |
| 112: GROOVE | |

BEST MODE

Hereinafter, exemplary embodiments of the present disclosure will be described in detail with reference to the accompanying drawings.

Generally, the temperature of rolls increases during a shape-correcting process, and thus rolls are designed to have initial thermal crown shapes in consideration of thermal expansion. However, if the process temperature of a shape-correcting process is increased, the temperature of rolls is also varied as the shape-correcting process proceeds. In this case, a proper initial roll shape is also varied. In addition, since the temperature of strips supplied to a correcting device is not uniform, the shapes of rolls are varied each time a new strip is supplied or while a strip is being fed. Therefore, initial roll crown shapes have to be changed. Due to this reason, the method of providing an initial thermal crown shape to a roll is not practical.

Particularly, if the shape of high-strength steel is corrected merely after increasing the temperature of the high-strength steel, shape errors occur due to a thermal crown, and thus the method of giving an initial thermal crown shape to a roll is not used.

According to the present disclosure, thin, wide, high-strength steel strips may be manufactured using a shape-correcting device through a shape-correcting process including a correcting process using heat pipe rollers.

Figure 1:
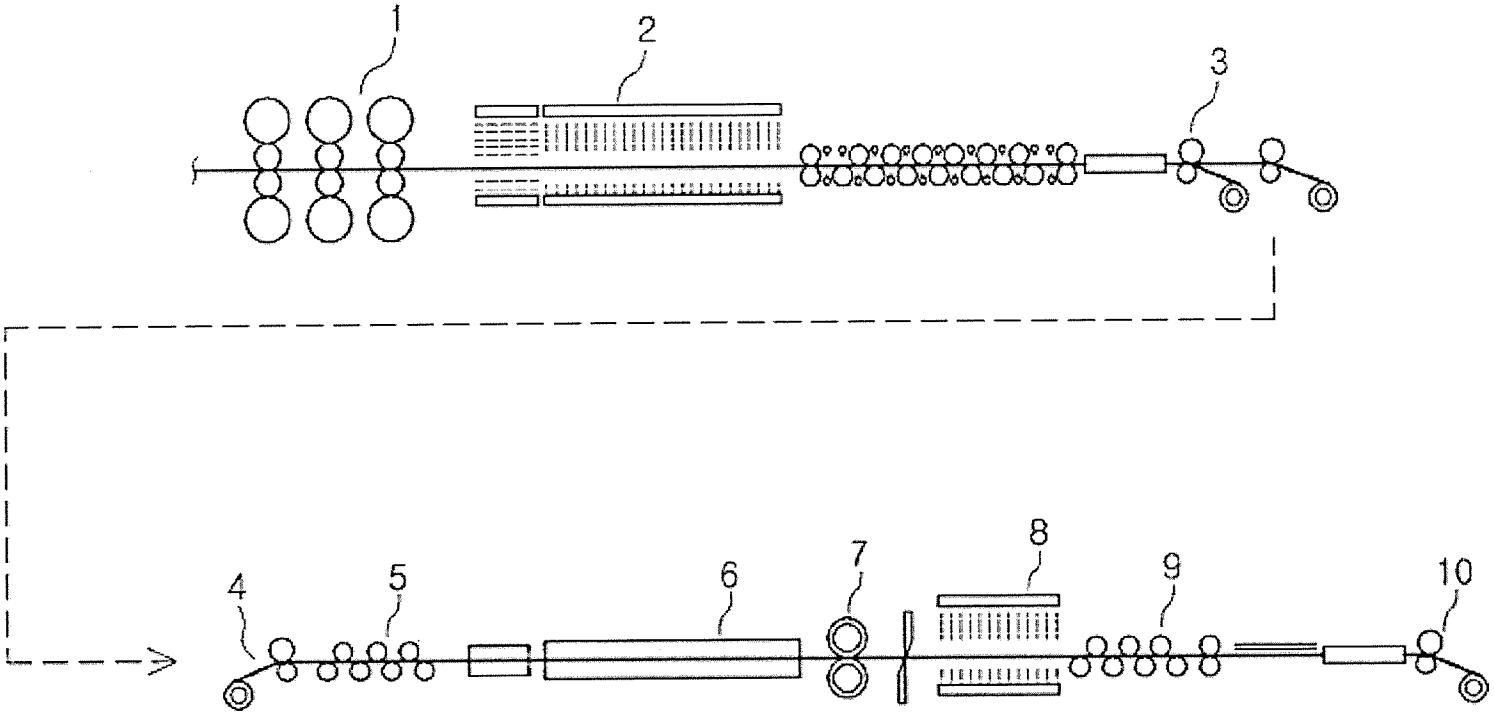
FIG. 1 Prior Art
FIG. 1 is a schematic view illustrating a hot rolling and correcting process of the related art.
Figure 2:
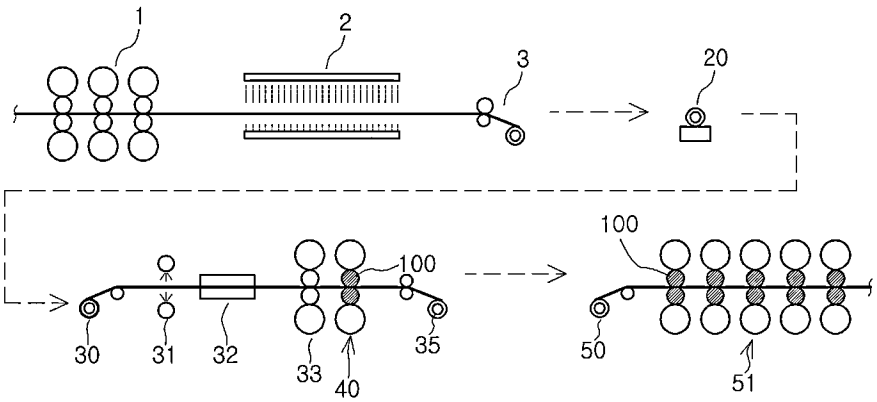
FIG. 2 is a schematic view illustrating a shape-correcting and rolling process for high-strength steel according to a first embodiment of the present disclosure.

FIG. 2 is a schematic view illustrating a shape-correcting and rolling process for high-strength steel according to a first embodiment of the present disclosure.

Referring to FIG. 2, after passing through hot rolling mills 1, a strip is cooled to a winding temperature by a cooling device 2, and is then coiled as a coil by a coiler 3. Thereafter, in a first transfer process, the coil is transferred to a yard for a temperature adjusting process 20. That is, the coil is placed on a yard. In the temperature adjusting process 20, the temperature of the coil (please refer to reference letter C in FIG. 8B) is continuously measured, and in a state in which the coil has a predetermined temperature, for example, a temperature of 150° C. or higher, the coil is transferred to a shape-correcting line through a second transfer process.

In the shape-correcting line, the coil is unwound using a pay-off reel 30, and the strip unwounded from the coil undergoes a scale removing process in which scale is removed from the strip by using a shot blaster 31. Thereafter, the temperature of the strip is uniformized using a heating device 32, and then the strip is first rolled by a rolling mill 33 and is then shape-corrected by a skin pass mill 40. Next, the strip is rewound by a coiler 35.

At this time, the skin pass mill 40 uses heat pipe rollers 100 to correct the shape of the strip. Thermal crowns of the heat pipe rollers 100 may be maintained at a constant level even in the case that the strip introduced between the heat pipe rollers 100 has a temperature of 150° C. or higher, and since the strip has a temperature of 150° C. or higher, the shape of the strip may be easily corrected even in the case that the strip is a high-strength steel strip.

The rewound coil is directly subjected to a rolling process in warm-working conditions, in which the strip is unwound from the coil using a pay-off reel 50 and is then rolled by six to eight rolling mills 51.

In the first embodiment, the hot rolling mills 1, the cooling device 2, and the coiler 3 are the same as those of the related art, and thus detailed descriptions thereof will be omitted.

In the present disclosure, since a strip having a temperature of 150° C. or higher is supplied to the shape-correcting line, a time necessary for a cooling process 20 may be reduced. Particularly, since the rate of cooling is relatively high at high temperature and relatively low at low temperature, the time necessary for the cooling process 20 may be markedly reduced to about one day, as compared to the related art, requiring three to five days.

Therefore, the flow of coils may be improved in the yard in which the cooling process 20 is performed, and thus the amount of inventory may be reduced. The cooling process 20 will be explained later in detail with reference to FIGS. 8A and 8B.

In the present disclosure, while the strip unwound from the pay-off reel 30 passes through the shot blaster 31, scale is removed from the strip. Then, when the strip passes through the rolling mill 33, the strip may not be damaged due to scale. When electrical steel strips or stainless steel strips are produced, before a pickling process, shot blasters are generally used to remove scale from the surfaces of the steel strips by shooting steel balls having a diameter of several tens of micrometers (μm) toward a strip from the upper and lower sides of the strip using centrifugal force.

After scale is removed from the strip using the shot blaster 31, the strip passes through the heating device 32. As long as the heating device 32 uniformizes the temperature of the strip, the heating device 32 may not heat the strip to a constant temperature. The heating device 32 may be an induction heater. When the strip is rolled using the rolling mill 33, if a model defining the relationship between an initial roll gap and a roll speed is operated based on logic for compensating for roll gap variations caused by temperature variations, the heating device 32 may not be used.

The rolling mill 33 performs a one-step rolling process at a reduction ratio of about 20% to about 30%. If the reduction ratio is greater than about 30%, shape errors may be increased to a degree to which the shape errors may not be corrected by the skin pass mill 40. Since the strip having a high degree of strength is rolled by the rolling mill 33 at a temperature of 150° C. or higher, the effect of rolling may be relatively large, as compared to the case in which the strip is rolled in a later process. Therefore, a wide and thin final product may be obtained.

After passing though the rolling mill 33, the strip is introduced to the skin pass mill 40 including the heat pipe rollers 100. In the present disclosure, since the skin pass mill 40 includes the heat pipe rollers 100, the skin pass mill 40 may be operated free from the temperature of the strip introduced to the skin pass mill 40. That is, although the strip has a relatively high temperature, the skin pass mill 40 may properly correct the shape of the strip. In detail, the heat pipe rollers 100 uniformly increase the overall temperature of rolls, thereby uniformizing thermal crown shapes and completely performing a shape-correcting process regardless of the temperature of an introduced strip or the number of rolled strips. The heat pipe rollers 100 will be described later in detail with reference to FIGS. 3 to 7.

After passing through the rolling mill 33 and the skin pass mill 40, the strip is rewound as a coil by the coiler 35, and then transferred for a rolling process. In the present disclosure, the coil processed along the shape-correcting line is directly subjected to the rolling process. Therefore, the rolling process may be performed within a warm-working temperature range. However, after an additional cooling process, the rolling process may be performed as a cold rolling process.

Figure 3A:
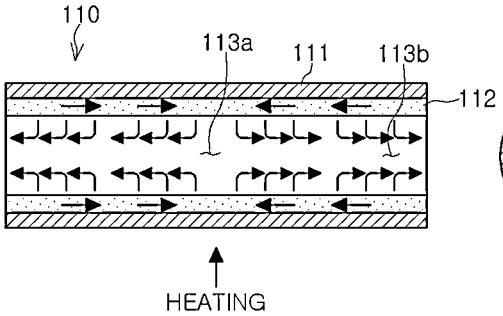
FIGS. 3A and 3B are a longitudinal sectional view and a cross sectional view illustrating a heat pipe.
Figure 3B:
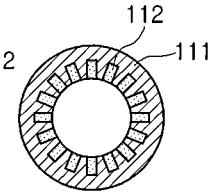
Figure 4:
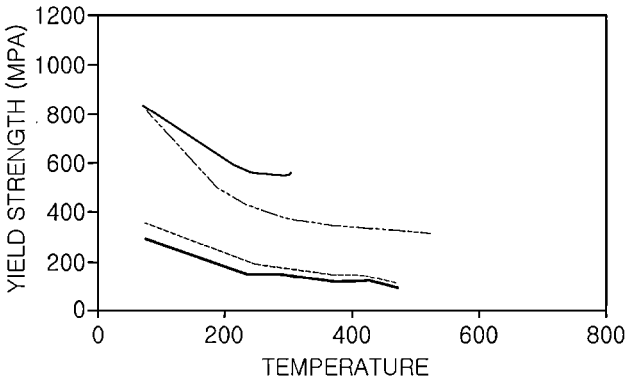
FIG. 4 is a graph illustrating yield strength versus temperature.
Figure 5:
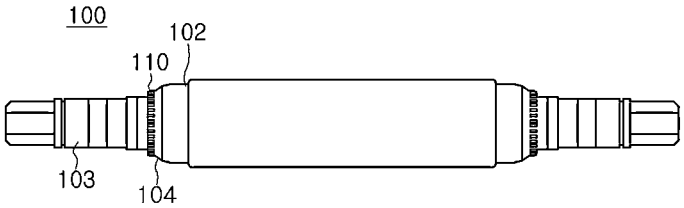
FIG. 5 is a front view illustrating a heat pipe roller according to the first embodiment of the present disclosure.
Figure 6:
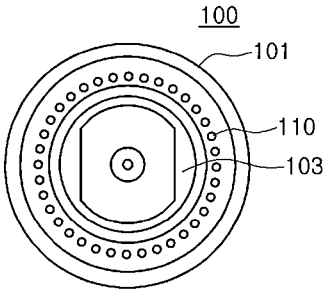
FIG. 6 is a side view illustrating the heat pipe roller illustrated in FIG. 6.
Figure 7:
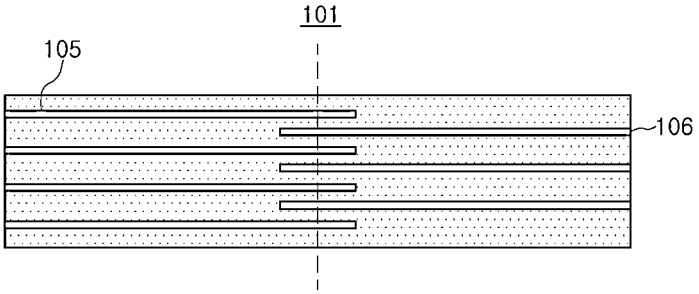
FIG. 7 is a schematic view illustrating the heat pipe roller in which heat pipes are installed.

FIGS. 3A to 7 illustrate a heat pipe roller 100 of the present disclosure. FIGS. 3A and 3B are a longitudinal sectional view and a cross sectional view illustrating a heat pipe 110 of the heat pipe roller 100. FIG. 4 is a graph illustrating the yield strength of high-strength steel with reference to temperature. FIG. 5 is a front view illustrating the heat pipe roller 100 of the present disclosure. FIG. 6 is a side view illustrating the heat pipe roller 100 of the present disclosure. FIG. 7 is a view illustrating the heat pipe roller 100 in which heat pipes 110 are installed.

According to the present disclosure, the heat pipes 110 are installed in the heat pipe roller 100. Referring to FIG. 3, each heat pipe 110 includes: a pipe 111 in which a vacuum is formed; and grooves 112 formed in the pipe 111 and filled with pure water. If the heat pipe 110 receives heat from a heating unit, the pure water evaporates, and a center region 113*a* of the heat pipe 110 is filled with steam. Since the steam filled in the center region 113*a* may increase pressure in the center region 113*a*, the steam moves to both end regions 113*b* having a low pressure and cools into pure water. Meanwhile, if the pure water filled in the grooves 112 is evaporated by heat, the pure water condensed from steam in the end regions 113*b* is moved back to the center region 113*a* by the capillary action of the grooves 112.

That is, since evaporation occurs in the center region 113*a* and condensation from steam occurs in the end regions 113*b*, steam moves from the center region 113*a* to the end regions 113*b*, and pure water moves from the end regions 113*b* to the center region 113*a*. Owing to this circulation in the heat pipe 110, heat transferred from the heating unit may be uniformly distributed throughout the heat pipe 110.

As shown in the graph of FIG. 4 illustrating the yield strength of high-strength steel with respect to temperature, the yield strength of high-strength steel considerably decreases at a temperature of 150° C. or higher. That is, at room temperature or a temperature of about 100° C., the yield strength of high-strength steel does not considerably decrease, and thus the effect of shape correction of high-strength steel is low. Thus, according to the present disclosure, strips having a temperature of at least 150° C. are used. However, strips having a temperature lower than 150° C. may be used. In this case, strips of high-strength steel are heated to a temperature lower than a phase transformation temperature of the high-strength steel.

Referring to FIGS. 5 to 7, the heat pipe roller 100 of the present disclosure is similar to a general shape-correcting roll except that the heat pipes 110 are installed in a journal 104 between a rolling portion 102 and neck portions 103.

Each of the heat pipes 110 may penetrate the rolling portion 102. However, for example, first heat pipes 105 may be inserted from one end of the rolling portion 102, and second heat pipes 106 may be inserted from the other end of the rolling portion 102.

The first and second heat pipes 105 and 106 may be alternately arranged in the circumferential direction of the rolling portion 102 for structural stability and benefits in manufacturing processes. That is, it may be advantageous to form insertion tubes of the first and second heat pipes 105 and 106 in such a manner that the insertion tubes do not meet each other, and in this case, the formation of cracks may be prevented even in the case that the load of a rolling process is repeatedly applied to the first and second heat pipes 105 and 106.

In addition, the first and second heat pipes 105 and 106 may overlap each other in a center region of the rolling portion 102. The temperature of a rolling roll is generally highest in a center region thereof. Therefore, if the first and second heat pipes 105 and 106 overlap each other in the center region of the rolling portion 102, the temperature of the center region of the rolling portion 102 may be effectively lowered, and thus the temperature difference between regions of the heat pipe roller 100 may be lowered.

According to the present disclosure, the shape of the heat pipe roller 100 may not be varied according to temperature. That is, the temperature difference between a center region and both end regions of the heat pipe roller 100 may be lowed. In other words, the temperature difference along the heat pipe roller 100 may be constantly maintained regardless of the temperature of a strip supplied to the heat pipe roller 100.

For example, when edges of the rolling portion 102 have a temperature of 50° C., the center region of the rolling portion 102 may be maintained at a temperature of about 65° C., and when the edges of the rolling portion 102 have a temperature of 70° C., the center region of the rolling portion 102 may be maintained at a temperature of about 85° C., so as to maintain the temperature difference between the center region and edges of the rolling portion 102 at a constant level. Therefore, a thermal crown shape caused by a temperature difference may be constantly maintained.

In the heat pipes 110 of the heat pipe roller 100, pure water evaporates into steam in a hot center region, and the steam moves to ends due to an increased pressure in the hot center region. Then, the steam condenses into pure water at the ends due to a low temperature, and the pure water moves back to the center region by the capillary action. As these actions are repeated, heat may be transferred from the center to edges of the heat pipe roller 100 by the evaporation and condensation of pure water, and thus the heat pipe roller 100 may have a uniform widthwise temperature distribution.

Figure 8A:
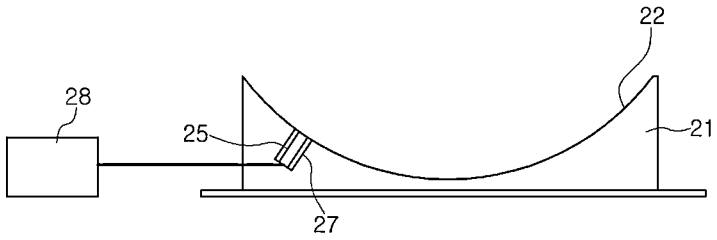
FIGS. 8A and 8B are schematic views illustrating a yard according to the first and second embodiments, FIG. 8A being a schematic view illustrating the yard before a coil is transferred to the yard, FIG. 8B being a schematic view illustrating the yard after a coil is transferred to the yard.
Figure 8B:
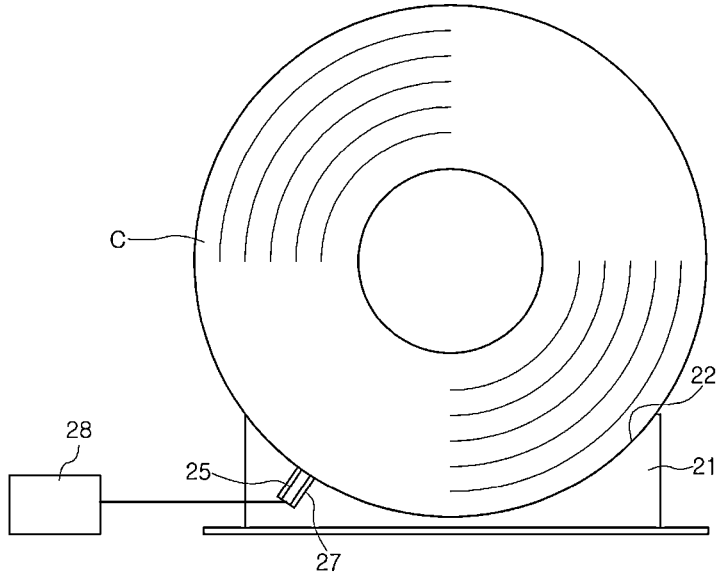

FIGS. 8A and 8B illustrate a skid useable in a yard in the above-described cooling process 20 of the present disclosure. Referring to FIGS. 8A and 8*b*, the skid is usable in the cooling process 20 of the present disclosure. A main body 21 of the skid includes a support surface 22 to receive a coil C thereon, and a penetration hole 27 is formed in the main body 21. A temperature sensor 25 is disposed in the penetration hole 27.

The temperature sensor 25 measures the temperature of the coil C and transmits the measured temperature to a monitoring unit (control unit) 28. The monitoring unit 28 compares the temperature of the coil C with a predetermined temperature range, and if the temperature of the coil C is within the temperature range, the coil C is transferred away from the yard and coupled to a pay-off reel.

The temperature range may be properly determined. For example, it may be preferable that the temperature range be set to equal to or higher than 150° C. in consideration of cooling of the coil C when the coil C is unwound from the pay-off reel.

Figure 9:
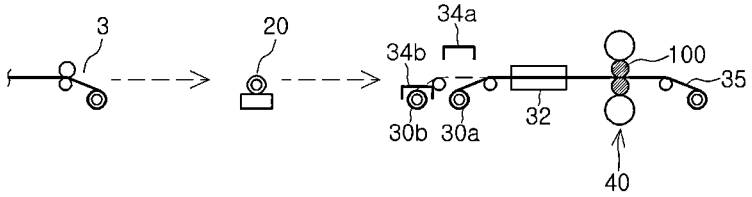
FIG. 9 is a schematic view illustrating a shape-correcting and rolling process for high-strength steel according to a second embodiment of the present disclosure.

FIG. 9 illustrates a second embodiment of the present disclosure.

Referring to FIG. 9, in the second embodiment of the present disclosure, a coil wound by a coiler 3 in a hot rolling process is transferred to a yard for a temperature adjusting process 20 in a first transfer process. In the temperature adjusting process 20, the temperature of the coil (please refer to reference letter C in FIG. 8B) is continuously measured, and in a state in which the coil has a predetermined temperature, for example, a temperature of 150° C. or higher, the coil is transferred to a shape-correcting line through a second transfer process.

In the shape-correcting line, a plurality of coils coupled to a plurality of pay-off reels 30*a* and 30*b* are sequentially unwound. Since an amount of time necessary for unwinding a coil after unwinding a previous coil is relatively long compared to an amount of time necessary for coupling the coils to the pay-off reels 30*a* and 30*b*, heat insulation covers 34*a* and 34*b* are used to maintain the temperature of the coils coupled to the pay-off reels 30*a* and 30*b* until the coils are unwound from the pay-off reels 30*a* and 30*b*. In other words, a heat insulating process may be performed using the heat insulation covers 34*a* and 34*b* to maintain the temperature of the coils coupled to the pay-off reels 30*a* and 30*b*. As shown in FIG. 9, the heat insulation covers 34*a* and 34*b* may be moved away from the pay-off reels 30*a* and 30*b* when the coils are unwound from the pay-off reels 30*a* and 30*b*. However, the heat insulation covers 34*a* and 34*b* may not be moved away from the pay-off reels 30*a* and 30*b* to maintain the temperature of the coils during unwinding of the coils.

Each strip unwound from the coils of the pay-off reels 30*a* and 30*b* passes through a heating device 32 in which the temperature of the strip is uniformized, and the shape of the strip is corrected by a skin pass mill 40. Thereafter, the strip is rewound by a coiler 35.

At this time, like in the first embodiment, the skin pass mill 40 uses heat pipe rollers 100 to correct the shape of the strip. A thermal crown of the heat pipe rollers 100 may be maintained at a constant level even in the case that the strip introduced between the heat pipe rollers 100 has a temperature of 150° C. or higher, and since the strip has a temperature of 150° C. or higher, the shape of the strip may be easily corrected even in the case that the strip is a high-strength steel strip.

Figure 10:
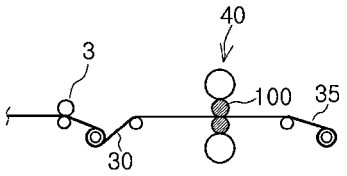
FIG. 10 is a schematic view illustrating a shape-correcting and rolling process for high-strength steel according to a third embodiment of the present disclosure.

FIG. 10 illustrates a third embodiment of the present disclosure.

In the third embodiment, a coil wound by a coiler 3 in a hot rolling process is directly transferred to a shape-correcting device without a cooling process 20. That is, the coil is directly wound from a pay-off reel. In FIG. 10, a single device functions as a coiler and a pay-off reel. However, a coiler and a pay-off reel may be used, and a coil wound by the coiler may be directly transferred to the pay-off reel. That is, as long as a coil processed through a hot rolling process is directly transferred to the shape-correcting device through a direct transfer process, any configuration may be used.

In the third embodiment, a strip unwound from a coil as described above is directly fed into a skin pass mill 40 for correcting the shape of the strip, and then the strip is rewound by a coiler 35. In the present disclosure, as described above, the skin pass mill 40 includes heat pipe rollers 100. Therefore, the skin pass mill 40 is free from the temperature of the strip, and thus even in the case that the strip has a high temperature, the shape of the strip may be stably corrected. In addition, as shown in FIG. 4, since the yield strength of the strip decreases as the temperature of the strip increases, the shape of the strip may be smoothly corrected.

Figure 11:
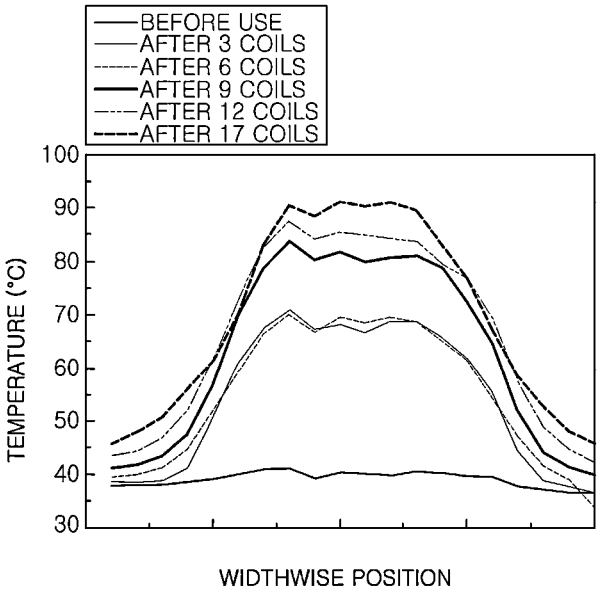
FIG. 11 is a graph illustrating the temperature of a roll of a shape-correcting device of the related art for different numbers of processed coils.
Figure 12:
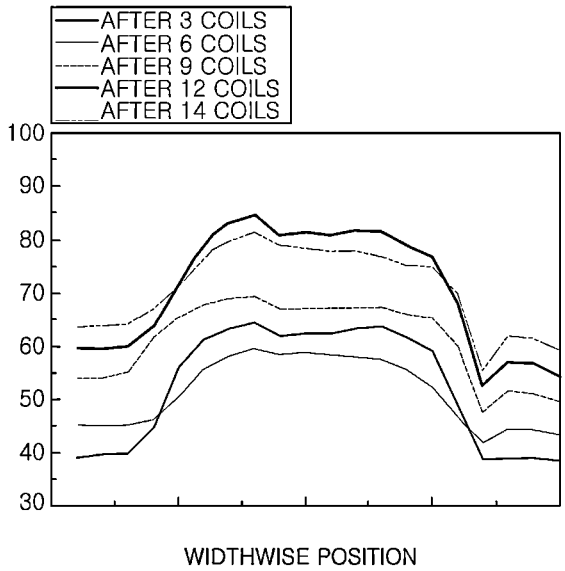
FIG. 12 is a graph illustrating the temperature of a roll of a shape-correcting device of the present disclosure for different numbers of processed coils.

FIG. 11 is a graph illustrating the temperature of a roll of a shape-correcting device of the related art with respect to the widthwise position of the roll when a strip having a temperature of 100° C. to 120° C. is corrected using the roll after different numbers of coils are processed. FIG. 12 is a graph illustrating the temperature of a roll of a shape-correcting device of the present disclosure with respect to the widthwise position of the roll when a strip having a temperature of 100° C. to 140° C. is corrected using the roll after different numbers of coils are processed.

Referring to FIG. 11, when the shape-correcting device of the related art is used, the temperature difference between a center region and edges of the roll ranges from 35° C. to 50° C., and the temperature difference increases as the number of processed coils increases. However, referring to FIG. 12, when the shape-correcting device of the present disclosure is used, although the overall temperature of the roll (heat pipe roller) increases as the number of processed coils increases, the temperature difference between a center region and edges of the heat pipe roller is constantly maintained within the range of about 20° C. to about 25° C.

That is, the temperature difference along the width of the heat pipe roller of the present disclosure is low. In addition, the temperature difference along the width of the heat pipe roller of the present disclosure may be constantly maintained even in the case that the overall temperature of the heat pipe roller increases.

Figure 13:
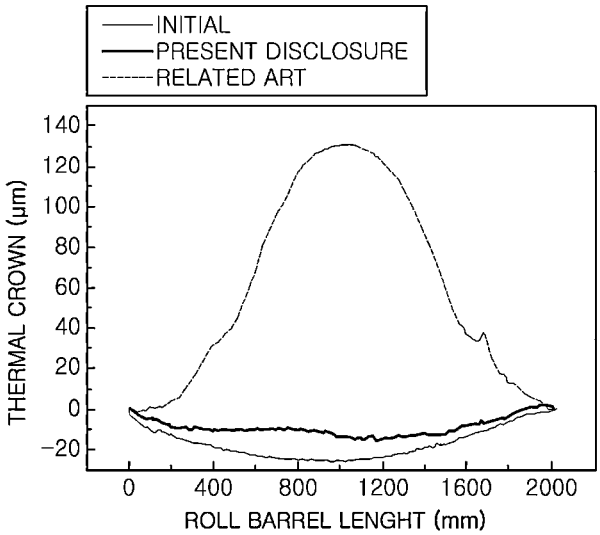
FIG. 13 is a graph illustrating thermal crowns of a shape-correcting device of the related art and the shape-correcting device of the present disclosure.

FIG. 13 is a graph illustrating thermal crowns of a shape-correcting device of the related art and the shape-correcting device of the present disclosure. As shown in FIG. 13, when heat pipe rollers of the present disclosure are used, thermal crowns of the heat pipe rollers are markedly small. Specifically, in the shape-correcting device of the related art, 150-μm thermal crowns are formed based on a center region thereof. However, if heat pipe rollers are used, thermal crown having a dimension of about 15 μm is formed. That is, the thermal crowns of the heat pipe rollers 100 of the present disclosure are merely about 1/10 the thermal crowns of general rolls.

As described above, if general rolls are used, since large thermal crowns having a dimension of 150 μm are formed in center regions of the rolls, a large wave shape may be formed on a center region of a strip, thereby making the strip useless as a product.

However, if the heat pipe rollers of the present disclosure are used, almost no thermal crown grows, and thus the shape of a strip may not be affected.

Figure 14:
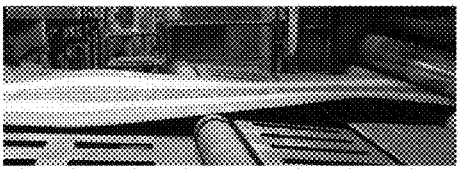
FIG. 14 is an image of a strip taken after a hot rolling process.
Figure 15:
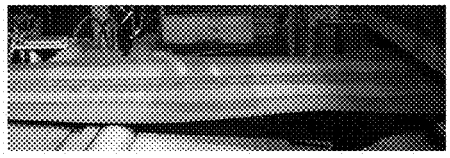
FIG. 15 is another image of the strip of FIG. 14 taken after the strip had passed through a shape-correcting device of the related art at room temperature.
Figure 16:
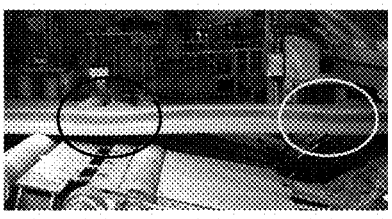
FIG. 16 is another image of the strip of FIG. 14 taken after the strip had passed through the shape-correcting device of the related art at a warm-working temperature.
Figure 17:
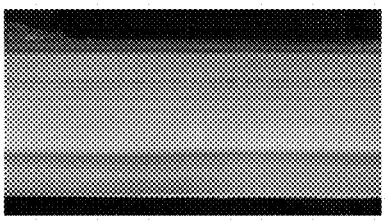
FIG. 17 is another image of the strip of FIG. 14 taken after the strip had passed through the shape-correcting device of the present disclosure.

FIGS. 14 to 17 are images of an actual strip. FIG. 14 is an image of a strip taken after a hot rolling process. FIG. 15 is another image of the strip of FIG. 14 taken after the strip had passed through a shape-correcting device of the related art at room temperature. FIG. 16 is another image of the strip of FIG. 14 taken after the strip had passed through the shape-correcting device of the related art at a warm-working temperature. FIG. 17 is another image of the strip of FIG. 14 after the strip had passed through the shape-correcting device of the present disclosure.

Referring to FIG. 14, the strip processed through a hot rolling process had edge waves. The edge waves of the strip remained after the strip had passed through the shape-correcting device of the related art at room temperature (please refer to FIG. 15). After the strip of FIG. 14 had passed through the shape-correcting device of the related art within the temperature range of 130° C. to 190° C., severe central waves were formed on the strip as shown in FIG. 16 (please refer to the circles of FIG. 16).

However, after the strip of FIG. 14 had passed through the shape-correcting device of the present disclosure within the temperature range of 130° C. to 190° C., the shape of the strip was corrected to be smooth as shown in FIG. 17.

If the shape of a strip is corrected as described above, the load of a later process may be reduced, and the strip may be less cut in the later process, thereby improving overall process efficiency.

MODE FOR INVENTION

Examples

Table 1 illustrates samples prepared using shape-correcting devices and methods of the related art and the present disclosure.

TABLE 1

| | Steel type | Roll type | Strip temperature (° C.) | Number of experiments (coils) | Average cutting amount (m) |
|---|---|---|---|---|---|
| *CS 1 | 1180CP | General roll | Room temperature | 15 | 37.1 |
| CS 2 | 980DP | General roll | Room temperature | 33 | 63.5 |
| **IS 1 | 1180CP | Heat pipe roller | 150 | 15 | 0 |
| IS 2 | 980DP | Heat pipe roller | 150 | 100 | 2.8 |

*CS: Comparative Sample,
**IS: Inventive Sample

As illustrated in Table 1, fifteen coils of 1180CP steel were tested using a shape-correcting device of the related art and the shape-correcting device of the present disclosure. When the shape-correcting device of the present disclosure was used, cutting was not necessary. However, when the shape-correcting device of the related art was used, the average amount of cutting was 37.1 m.

In addition, when thirty three coils of steel 980DP were shape-corrected using the shape-correcting device of the related, the average amount of cutting was 63.5 m. However, in the case of the present disclosure (heat pipe rollers+150° C.), the average amount of cutting was only 2.8 m when one hundred coils were shape-corrected.

As described above, the shape-correcting and rolling method or the shape-correcting device of the present disclosure has remarkable effects on high-strength steel compared to methods or devices of the related art. Particularly, cutting lengths may be markedly reduced, and high-strength steel may be formed into wide and thin sheets.

While exemplary embodiments have been shown and described above mainly based on the first to third embodiments, it will be apparent to those skilled in the art that modifications and variations could be made without departing from the scope of the present invention as defined by the appended claims.

The invention claimed is:

1. A shape-correcting and rolling method for high-strength steel, comprising:
- performing a hot rolling to skin pass mill direct transfer process by transferring a hot-rolled coil to a pay-off reel;
- unwinding a strip from the coil of the pay-off reel;
- correcting a shape of the strip by using at least a pair of heat pipe rollers; and
- rewinding the strip as a coil,
- wherein each of the heat pipe rollers comprises
  - a plurality of first heat pipes extending in a length direction of the heat pipe roller from an end to a center region of the heat pipe roller and
  - a plurality of second heat pipes extending from an opposite end to the center region,
- the plurality of first and the plurality of second heat pipes are alternately arranged in a circumferential direction of the heat pipe roller, and
- the plurality of first and the plurality of second heat pipes overlap each other only in the center region in the length direction of the heat pipe roller.

2. The shape-correcting and rolling method of claim 1, wherein prior to the correcting of the shape of the strip, the method further comprises rolling the strip at a reduction ratio of 20% to 30%.

3. The shape-correcting and rolling method of claim 2, wherein prior to the rolling of the strip, the method further comprises removing scale from surfaces of the strip by shot blasting.

4. The shape-correcting and rolling method of claim 1, wherein in the correcting of the shape of the strip, the strip has a temperature equal to or higher than 150° C., but lower than a phase transformation temperature.

5. The shape-correcting and rolling method of claim 4, further comprising warm-rolling the strip.

6. The shape-correcting and rolling method of claim 1, wherein a heat insulating process is performed on the coil during the unwinding of the coil, so as to prevent cooling of the coil.

7. The shape-correcting and rolling method of claim 1, wherein prior to the correcting of the shape of the strip, the method further comprises heating the strip so that the strip has a uniform temperature.

8. A shape-correcting and rolling method for high-strength steel, comprising:
- performing a first transfer process by transferring a hot-rolled coil to a temperature adjusting unit;
- cooling the coil while monitoring a temperature of the coil;
- performing a second transfer process by transferring the coil cooled to a temperature of 150° C. or higher to a pay-off reel;
- unwinding a strip from the coil of the pay-off reel;
- correcting a shape of the strip by using a pair of heat rollers; and
- rewinding the strip as a coil,
- wherein each of the heat pipe rollers comprises
  - a plurality of first heat pipes extending in a length direction of the heat pipe roller from an end to a center region of the heat pipe roller and
  - a plurality of second heat pipes extending from an opposite end to the center region,
- the plurality of first and the plurality of second heat pipes are alternately arranged in a circumferential direction of the heat pipe roller, and
- the plurality of first and the plurality of second heat pipes overlap each other only in the center region in the length direction of the heat pipe roller.

9. The shape-correcting and rolling method of claim 2, wherein the cooling of the coil comprises:
- measuring the temperature of the coil; and
- comparing the measured temperature of the coil with a predetermined temperature range so as to determine whether the measured temperature of the coil is within the predetermined temperature range.

10. The shape-correcting and rolling method of claim 9, wherein the cooling of the coil is performed by placing the coil on a skid in a yard, and
- a thermocouple disposed in the skid indirectly measures the temperature of the coil by measuring a temperature of the skid heated by the coil placed on the skid.

11. A shape-correcting device for high-strength steel, the shape-correcting device comprising:
- a pay-off reel from which a coil is unwound;
- a skin pass mill correcting a strip unwound from the coil of the pay-off reel; and
- a coiler rewinding the strip after the strip passes through the skin pass mill, wherein the skin pass mill comprises a work roll that is a heat pipe roller in which heat pipes are installed, wherein the heat pipes comprise a plurality of first heat pipes extending in a length direction of the work roll from an end to a center region of the work roll and a plurality of second heat pipes extending from an opposite end to the center region, the plurality of first and the plurality of second heat pipes are alternately arranged in a circumferential direction of the work roll, and one of the plurality of the first heat pipes and one of the plurality of the second heat pipes overlap each other only in the center region in the length direction of the work roll.

12. The shape-correcting device of claim 11, wherein the heat pipes are uniformly arranged in the circumferential direction of the work roll at a predetermined insertion depth.

13. The shape-correcting device of claim 11, wherein a heating device is disposed between the pay-off reel and the skin pass mill so as to heat the strip to a temperature equal to or higher than 150° C. but lower than a phase transformation temperature.

14. The shape-correcting device of claim 11, further comprising a shot blaster configured to shoot steel balls having a micrometer (μm) size toward the strip and a rolling mill disposed behind the shot blaster to roll the strip, wherein the shot blaster and the rolling mill are disposed between the pay-off reel and the skin pass mill.

15. The shape-correcting device of claim 11, further comprising at least one additional pay-off reel and a heat insulation cover, wherein when one of the pay-off reels is operated, the heat insulation cover covers the remaining pay-off reel that is not operated and a coil disposed on the remaining pay-off reel.

* * * * *